United States Patent [19]

Steeger et al.

[11] 4,441,050

[45] Apr. 3, 1984

[54] SINGLE-ENDED LOW PRESSURE DISCHARGE LAMP AND METHOD OF MANUFACTURE

[75] Inventors: Gerhard Steeger; Josef Plischke, both of Augsburg, Fed. Rep. of Germany

[73] Assignee: Patent-Treuhand-Gesellschaft Für elektrische Glühlampen mbH, Munich, Fed. Rep. of Germany

[21] Appl. No.: 415,451

[22] Filed: Sep. 7, 1982

[30] Foreign Application Priority Data

Oct. 6, 1981 [DE] Fed. Rep. of Germany ..... 3139732

[51] Int. Cl.[3] ..... H01J 1/92; H01J 9/26

[52] U.S. Cl. ..... 313/493; 313/318; 445/26

[58] Field of Search ..... 313/493, 318, 609, 610, 313/634; 445/26

[56] References Cited

U.S. PATENT DOCUMENTS 4,199,708 4/1980 Lauwerijssen et al. ..... 313/493

FOREIGN PATENT DOCUMENTS 57-78749 5/1982 Japan ..... 445/26

*Primary Examiner*—Palmer C. Demeo
*Assistant Examiner*—Sandra L. O'Shea
*Attorney, Agent, or Firm*—Frishauf, Holtz, Goodman and Woodward

[57] ABSTRACT

Two U-shaped inner tubes, each of which have a straight leg which is hermetically sealed about a preheatable electrode, are sealed into the upper, oval reception section of a preshaped flare. The seal also includes the exhaust tube and the lead-in wire pairs supporting the preheatable electrodes and is carried out as a press seal in one single working step. The other legs of the U-shaped inner tubes remain open. The lower, outwardly facing rim of the preshaped flare which is concentric with the longitudinal lamp axis is sealed to an outer envelope whose neck drops off during this sealing process and which surrounds the U-shaped inner tubes and contains a gas and/or metal vapor filling. The inner tubes are preferably coated with a three-line phosphor, and the outer envelope is provided with a light diffusing coating. The single-ended low-pressure discharge lamp may largely be manufactured on conventional machines and may be directly used in place of an incandescent lamp as a compact lamp of low electrical wattage when a starting and operating circuitry is incorporated in a conventional type of base used for incandescent lamps. Also disclosed are methods of manufacture of such a lamp.

17 Claims, 7 Drawing Figures

SINGLE-ENDED LOW PRESSURE DISCHARGE LAMP AND METHOD OF MANUFACTURE

BACKGROUND OF THE INVENTION

This invention relates to a single-ended low-pressure discharge lamp, and more particularly to such a lamp which comprises substantially a stem member, an outer envelope with a gas and/or metal vapor filling which is hermetically sealed thereto, two preheatable electrodes arranged within the outer envelope at the stem member and at least one U-shaped inner tube of glass which is also arranged within the outer envelope, with the end of one of the straight limbs or legs of each U-shaped inner tube hermetically surrounding one preheatable electrode and the end of each of the other straight limbs or legs of each inner tube having an aperture communicating with the outer envelope arranged adjacent the stem member. The invention also relates to methods of manufacture of such lamps.

Lamps of such a construction are called compact lamps because they are much shorter than conventional low pressure discharge lamps. When they are equipped with a ballast, starter and screw base, they may be operated in conventional incandescent lamp sockets. With an appropriate construction, such compact lamps are suited as a direct replacement for incandescent lamps. Compact lamps are more economical than incandescent lamps because of their greater efficiency in converting electrical energy into visible light and because of their longer life. In spite of this clear advantage, compact lamps have not yet gained wide acceptance. On the one hand, the proposed constructions are still too complex so that the manufacturing costs rise and the price which the consumer has to pay is higher than the price he is prepared to pay. On the other hand, the light output of lamps of simpler construction is not yet satisfactory. The general aim in the development of compact lamps is to obtain high light output and good color rendition, with the size, shape and price coming as closely as possible to the size, shape and price of the incandescent lamp.

From DE-OS 28 35 574, which corresponds to U.S. Pat. No. 4,199,708, issued Apr. 22, 1980, there is known a single-ended low-pressure discharge lamp which has at least one U-shaped inner tube arranged in the outer envelope. The first end of this inner tube is hermetically sealed about a preheatable electrode, and the other end has an aperture opening to the lamp envelope. The hermetic seal between the U-shaped inner tube and the preheatable electrode to the outer envelope which contains the gas filling is effected by means of an intermediate sealing glass and a chromium iron plate serving as the stem. The soldering of all these components to the intermediate sealing glass requires a complex and thus relatively expensive manufacturing technique. This method of sealing is less suitable to manufacturing large quantities of lamps on fully automatic machines because of the frequently occurring soldering deficiencies.

It is an object of the invention to provide a single-ended low-pressure discharge lamp of the initially described type which as a compact lamp of low power input is comparable in shape and light output to an incandescent lamp and may therefore be used in existing lighting fittings.

A further object of the invention is to permit manufacture of such lamps on high performance machines in order to be able to offer the finished product at a favorable price, and to provide efficient methods of manufacture thereof.

SUMMARY OF THE INVENTION

According to the present invention, a low-pressure discharge lamp comprises a preshaped stem member; an outer envelope which contains a gas and/or metal vapor filling and which is hermetically sealed to the preshaped stem member; two preheatable electrodes arranged within the outer envelope at the stem member; and at least one generally U-shaped inner tube of glass which is also arranged within the outer envelope, the at least one U-shaped inner tube having substantially straight legs, a first end of one of the straight legs of each inner tube hermetically surrounding one of the preheatable electrodes and the end of the other straight legs of each inner tube having an aperture open to the interior of the outer envelope, the apertures being arranged adjacent the stem member. The lamp is characterized in accordance with the invention in that the stem member is a preshaped flare of glass which comprises an upper reception section facing the interior of the lamp in which are sealed the two preheatable electrodes and the respective first end of each U-shaped inner tube and which is further provided with a lower, outwardly facing rim which is concentric with the longitudinal lamp axis and is fused to the outer envelope, with the reception section and the rim being connected by a substantially hollow cylindrical middle section. The operating voltage of the lamp and thus its power input is advantageously raised by an extension of the discharge path by associating a U-shaped inner tube with each of the two preheatable electrodes. The longitudinal axes of the straight limbs or legs of the two U-shaped inner tubes form in the top plan view substantially the corners of a rhombus or a square whose diagonals form a point of intersection lying on the longitudinal lamp axis.

The invention also encompasses methods of manufacturing the above described lamps, which methods are described and claimed hereinbelow.

The invention is described in greater detail in conjunction with the drawings in which one embodiment thereof is shown in schematic illustration.

DETAILED DESCRIPTION

Figure 1:
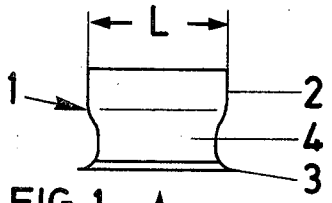
FIG. 1 is an elevation view of the preshaped flare of the lamp of the present invention.
Figure 2A:
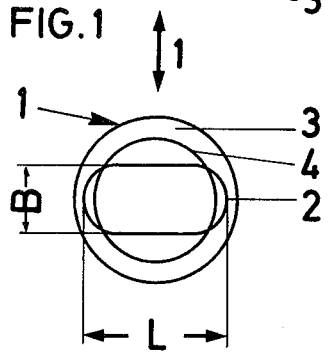
FIG. 2*a* is a top plan view of the preshaped flare in a first embodiment thereof.

The preshaped flare or stem member 1 shown in FIGS. 1 and 2*a* comprises an upper reception section 2 facing the interior of the lamp which in top plan view (FIG. 2*a*) has the shape of an oval opening. This oval opening is intended for the reception of the first ends of the U-shaped inner tubes (described hereinbelow). The width B of oval opening 2 is matched to the outer diameter of the inner tubes and the length L of oval opening 2 corresponds approximately with the length of the future press seal.

Figure 2B:
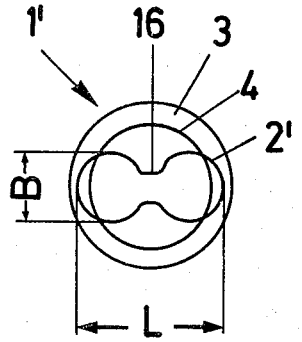
FIG. 2*b* is a top plan view of the preshaped flare in a second embodiment thereof.

In FIG. 2*b*, the segments, which connect the generally semicircular end portions of the generally oval opening 2' have constrictions 16 with respect to the longitudinal lamp axis so that there results an opening 2' having approximately the shape of a figure-eight.

In FIGS. 2*a* and 2*b*, the lower, outwardly facing rim 3 of the stem member of flare 1, 1', respectively, is circular and forms the future sealing line with the outer envelope. The middle section 4 between the reception section 2 and the rim 3 is formed by a substantially hollow cylindrical section whose diameter is smaller than both the diameter of the rim 3 and the length L of the reception section 2. The height of the flare 1, 1' is about 25 mm, and the rim 3 has a diameter of about 37 mm to 40 mm. The diameter of the hollow cylindrical middle portion is about 30 mm.

Figure 3:
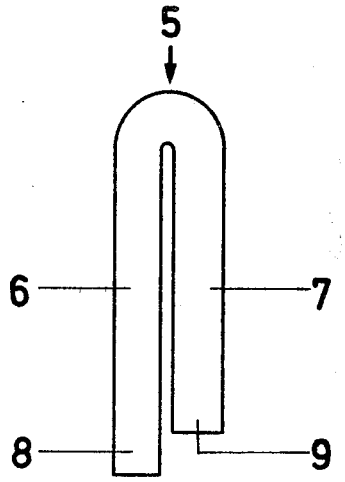
FIG. 3 is a side view of a U-shaped inner tube of the lamp of the present invention.

In FIG. 3 is illustrated a U-shaped inner tube 5 with two straight limbs or legs 6 and 7. The first leg 6 is about 10 mm longer than the second leg 7. The extended end 8 of the first leg 6 is provided for insertion into the reception section 2 of the flare 1 and has no phosphor coating applied to it. The other leg 7 has at its lower end an opening 9 which remains open. The outer diameter of the inner tube 5 is about 12 mm. With a wall thickness of about 1 mm, the inner diameter is thus about 10 mm. Between the straight legs 6 and 7 there remains a space of about 3 mm.

Figure 4:
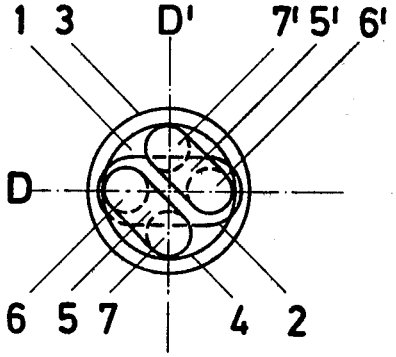
FIG. 4 is a top plan view of the combined base assembly thereof prior to press sealing.

FIG. 4 is a top plan view of the preassembled basic mount which includes two identical phosphor coated U-shaped inner tubes 5 and 5' in the reception section 2 of the flare 1. The four straight legs 6, 7 and 6', 7' extend substantially parallel to one another, with their longitudinal axes forming the corners of a rhombus or a square. The diagonals D and D' connecting the corners intersect on the longitudinal lamp axis. The preheatable electrodes supported by a H-mount (not shown) are arranged within the legs 6 and 6'. The heating and press sealing of the preassembled basic mount so supported is effected along the length L of the oval opening of the reception section 2. From the underside of the flare 1, an exhaust tube (not shown) arranged on the longitudinal lamp axis is simultaneously press sealed into the reception section 2.

Figure 5:
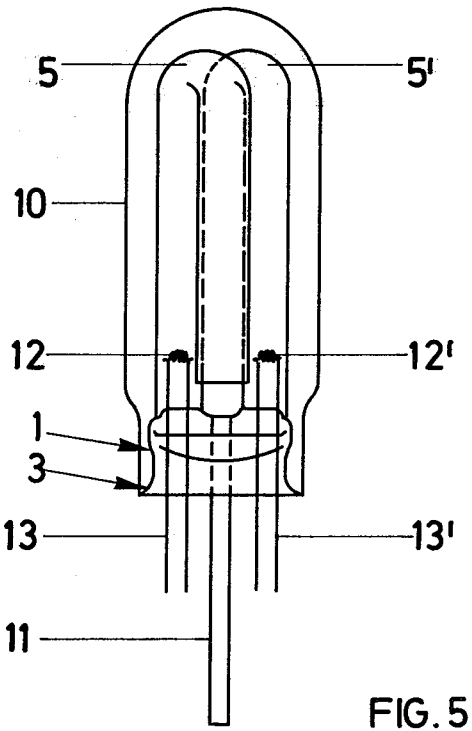
FIG. 5 illustrates a sealed-in lamp.

As shown in FIG. 5, a tubular outer envelope 10 having an outer diameter of from about 38 mm to about 50 mm is placed over the press sealed preassembled basic mount of FIG. 4 and is fused to the lower rim 3 of the flare 1. During the sealing of outer envelope 10 to the lower rim 3 of the flare, the neck or free end of outer envelope 10 falls or drops off. An exhaust tube 11 projects from the underside of the flare 1 of the sealed lamp. The exhaust tube 11 is also sealed in, and the lead-in wire pairs 13 and 13' are embedded in the seal and pass to the electrodes 12 and 12' interior of the lamp. The lead-in wires 13 and 13' may be of the single-part or multi-part type, and copperclad wire is a material particularly suited for them.

Figure 6:
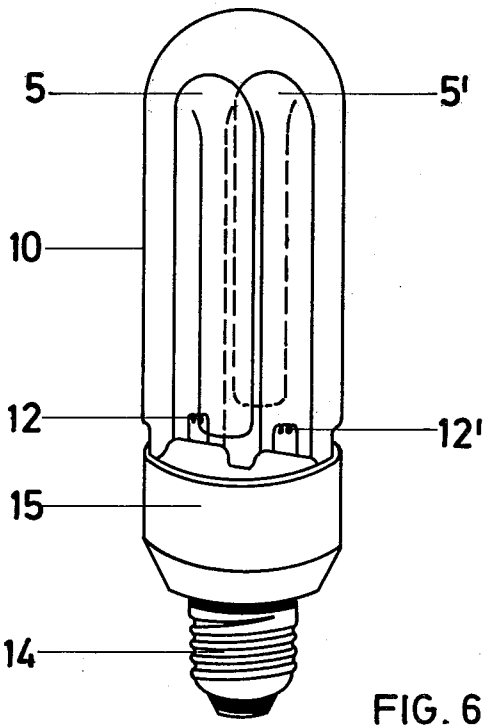
FIG. 6 illustrates a finished lamp in perspective view.

After the lamp has been evacuated and filled, the exhaust tube 11 is tipped off close to the seal between the outer envelope 10 and the rim 3 of the flare 1, and a base 14 is affixed to the lamp as shown in FIG. 6. For the direct connection to the power supply—for instance as a replacement for an incandescent lamp—a known electronic starting and ballast device may be incorporated in the base shell 15.

Due to the provision of two U-shaped inner tubes, a compact low-pressure discharge lamp in accordance with the invention has a discharge length of about 460 mm. As a filling, the compact lamp contains mercury in a quantity of about 10 mg and about 300 Pa argon. With a power input of about 15 W, the lamp has an operating voltage of about 100 V and a lamp current of about 170 mA. The luminous flux is about 1000 lm.

The hermetic seal between the first ends of legs 6, 6' of the U-shaped inner tubes 5, 5' with the preheatable electrodes 12, 12' and the upper reception section 2 of the preshaped flare 1 facing the interior of the lamp is designed in accordance with the invention in the form of a press seal, with the length of the press seal corresponding approximately with the length of the reception section 2. The section of with upper portion of the flare receiving the first ends of the U-shaped inner tubes has an oval opening 2 prior to the press-sealing process, the width of the oval opening 2 being somewhat larger than the outer diameter of the inner tubes 5, 5'. In a specific embodiment of the invention, the segments which connects the generally semicircular end pieces of the opening of the reception section 2 may be drawn inward to the longitudinal lamp axis so that in the top plan view this results approximately the shape of a figure-eight, as shown in FIG. 2*b*.

The lower, outwardly facing rim 3 of the flare 1, 1' is circular and concentric with the longitudinal lamp axis. Its diameter is matched to the inner diameter of the preferably light diffusing outer envelope 10. The hermetic sealing of rim 3 to outer tube envelope 10 may largely be carried out on conventional sealing machines for incandescent lamps. The middle section 4 connecting the oval reception section 2 and the concentric rim 3 of the preshaped flare 1, 1' is hollow cylindrical. The diameter of the middle section is smaller than the length of the reception section 2 and smaller than the diameter of the rim 3 of the preshaped flare.

The discharge vessel which comprises the outer envelope 10 and especially the U-shaped inner tubes 5, 5' contains as a filling preferably mercury and a rare gas. When the inner tubes 5, 5' are particularly narrow, an amalgam forming substance may be arranged in the interior thereof adjacent the closed end. This causes the mercury which has migrated to the outer envelope 10 because of the thermal conditions occurring during operation of the lamp to return in a continuous dynamic process so that the total volume of the inner tube or tubes 5, 5' is uniformly filled with mercury vapor. The UV radiation generated by the low-pressure discharge is converted into visible radiation by appropriate phosphor coatings on the inner surface of the inner tubes 5, 5' and, if required, on the inner surface of the outer envelope 10, as is known. It has proved advantageous to use a so-called three-line phosphor which contains red, green and blue emitting individual components.

When no phosphor layer is applied on the outer envelope 10, various coating embodiments may conceivably be used for it. As is customary with incandescent lamps, a clear glass surface or a light diffusing surface may be used such as is obtained for example by inside frosting or silica coating.

The outer envelope 10 is provided at the electrode end with a base shell 15. It is advantageous to use a screw base 14 across which the electrical connection of the lamp is effected and which may be inserted into customary incandescent lamp sockets. The lamp may also be equipped with other types of bases if desired.

With a ballast arranged inside the base shell 15, the lamp may be operated in every appropriate incandescent lamp socket. The lamp of the invention may also be operated, however, with a customary ballast choke which may for instance be designed as an adapter for the lamp or may be a component of the lighting fixture.

The manufacture of the low-pressure discharge lamp is simple, largely because of the preshaped flare 1, 1'. The preshaped flare 1, 1' is manufactured from a starting glass tube whose initial diameter corresponds with the diameter of the middle section of the finished preshaped flare and which is opened out at one end, thus providing the outwardly facing rim 3 of the flare. This flare blank is placed in a rotating reception device so that it is also rotated and is heated at the upper cylindrical section gradually to a temperature suited for the deformation of the glass. Then, an inner mold member is inserted from above into the interior of the heated flare blank, and two outer mold members are closed about the outer surface of the upper section of the flare blank. By this, the heated upper flare section receives the desired shape of the reception section 2 with the oval opening. During the shaping process, the reception device for the flare does not rotate. The shaping tools for the oval opening of the reception section may have different designs. The sides of the oval opening may be straight (FIG. 2*a*) or may have an inward curve so as to generally resemble a figure-eight (FIG. 2*b*). After the shaped glass has regained sufficient rigidity, the inner mold member is removed, with a stripper preventing the preshaped flare from sticking to the inner mold member, and the outer mold members are opened. The preshaped flare is then tempered and may be used as an essential component in the further manufacturing steps of the lamp of the present invention.

In the subsequent lamp manufacture, a mount comprising the preheatable electrodes 12, 12' is advantageously provided with single-part lead-in wires which may be supported for example by a not shown H-mount. Mounts supported in a reception device during the press sealing process are also conceivable. Also, multi-part lead-in wires may be used instead of the single-part lead-in wires. The preshaped flare 1, 1' is placed over two of these mounts which are supported at a defined spacing. Then, the two U-shaped inner tubes 5, 5' are inserted from above with their respective first straight legs into the upper oval section of the preshaped flare so that their first ends which are not coated with phosphor surround the mounts. The members so joined are heated in the region of the reception section of the flare to a temperature suited for the deformation of the glass. During the press sealing process which now follows and where care has to be taken in positioning all of the components particularly well, both seals of the U-shaped inner tubes are made in one single working step. The further manufacturing steps carried out until the lamp is finished are largely in accordance with known working steps. The outer envelope may have a portion which projects downwardly beyond the rim 3 of the flare, and the outer envelope is hermetically sealed to the lower rim 3 of the flare, which is concentric with the lamp axis, on a sealing machine with the downwardly projecting position falling off. Or, the envelope neck which has been heated to the deformation temperature may be pressed to the heated rim 3 of the flare by a roller to produce the hermetic seal therebetween. After evacuating, filling and basing, the lamp is ready for operation.

The low-pressure discharge lamp in accordance with the invention has, in addition to compact dimensions, good photometric properties. The above described inner mount is simple both in construction and manufacture and yields a discharge path of sufficient length.

We claim:

1. A single-ended low-pressure discharge lamp comprising:

a preshaped stem member (1);

an outer envelope (10) which contains a gas and/or metal vapor filling and which is hermetically sealed to said preshaped stem member (1);

two preheatable electrodes (12, 12') arranged within said outer envelope (10) at said stem member (1); and at least one generally U-shaped inner tube (5, 5') of glass which is also arranged within said outer envelope (10), said at least one U-shaped inner tube having substantially straight legs (6, 7), a first end (8) of one of said straight legs (6) of each inner tube (5, 5') hermetically surrounding one of said preheatable electrodes (12, 12') and the end of the other straight legs (7) of each inner tube (5, 5') having an aperture (9) open to the interior of said outer envelope (10), said apertures (9) being arranged adjacent said stem member (1);

said stem member (1) comprising a preshaped flare (1) of glass which comprises:

an upper reception section (2) facing the interior of said outer envelope (10) of the lamp and in which are sealingly mounted said two preheatable electrodes (12, 12'), said respective first ends (8) of each U-shaped inner tube (5, 5') also being sealed to said upper reception section (2) of said preshaped flare (1), a lower, outwardly facing rim (3) which is concentric with the longitudinal axis of the lamp and which is fused to said outer envelope (10); and a substantially hollow cylindrical middle section (4) connected between said reception section (2) and said rim (3).

2. The low-pressure discharge lamp of claim 1, comprising two generally U-shaped inner tubes (5, 5') and wherein each preheatable electrode (12, 12') is associated with a respective inner tube, the longitudinal axes of said substantially straight legs of said inner tubes (5, 5') forming in top plan view substantially the corners of a rhombus or a square whose diagonals (D, D') form a point of intersection lying on the longitudinal lamp axis.

3. The low-pressure discharge lamp of claims 1 or 2, wherein said hermetic seal between said first ends (8) of said generally U-shaped inner tubes (5, 5') with said preheatable electrodes (12, 12') and the upper reception section (2) of said preshaped flare (1) facing the interior of the lamp, comprises a press seal, the length of the press seal corresponding approximately with a length L of said reception section (2), said length L being taken transverse to the longitudinal axis of the lamp.

4. The low-pressure discharge lamp of claims 1 or 2, wherein said hermetic seal between said outer envelope (10) and said lower outwardly facing rim (3) of said preshaped flare (1) in the top plan view is in the form of a circle whose center point lies on the longitudinal lamp axis.

5. The low-pressure discharge lamp of claims 1 or 2, wherein the inner surface of said generally U-shaped inner tubes (5, 5') is provided with a phosphor coating.

6. The low-pressure discharge lamp of claims 1 or 2, wherein the inner surface of said outer envelope (10) is provided with a phosphor coating.

7. The low-pressure discharge lamp of claim 5, wherein said phosphor coating comprises three different phosphor components.

8. The low-pressure discharge lamp of claim 5, wherein the inner surface of said outer envelope (10) comprises a light diffusing surface.

9. The low-pressure discharge lamp of claims 1 or 2 wherein the inner surface of said outer envelope (10) comprises a light diffusing surface.

10. The low-pressure discharge lamp of claims 1 or 2, wherein the upper reception section (2) of said preshaped flare (1) has an oval shape in plan view, and in which said at least one inner tube is sealed.

11. The low-pressure discharge lamp of claim 3 wherein the upper reception section (2) of said preshaped flare (1) has an oval shape in plan view, and in which said at least one inner tube is sealed.

12. The low-pressure discharge lamp of claims 1 or 2, wherein the upper reception section (2) of said preshaped flare (1) has a generally figure-eight shape in plan view, and in which said at least one inner tube is sealed.

13. The low-pressure discharge lamp of claim 3 wherein the upper reception section (2) of said preshaped flare (1) has a generally figure-eight shape in plan view, and in which said at least one inner tube is sealed.

14. A method of manufacturing a preshaped flare for a single-ended low-pressure discharge lamp as claimed in claim 1, wherein said stem member initially includes a glass flare blank having a cylindrical glass end section comprising:

(a) heating of an end portion of said cylindrical glass end section of said glass flare blank to a temperature suited for the deformation of the glass thereof;

(b) rotating said flare blank during said heating of said end portion of said flare blank;

(c) inserting an inner mold member, which corresponds with a generally oval opening of said reception section (2), into said heated end portion of said flare blank and subsequently closing outer mold members around the outer surface of said heated flare blank end portion, said mold members having surface shapes which correspond with the oval opening of said reception section (2), the rotation of said heated flare blank being stopped during the shaping process by means of said molds; and (d) removing said inner mold member from said preshaped flare (1) and subsequently opening said outer mold members, with a stripper preventing said preshaped flare (1) from sticking to said inner mold member.

15. A method of manufacturing a single-ended low-pressure discharge lamp as claimed in claim 1, comprising:

(a) holding of the lead-in wires (13, 13') which are provided with the preheatable electrodes (12, 12') in relation to the preshaped flare (1) so that the portions of the lead-in wires which are to be sealed in are arranged at the height of the reception section (2) of the flare (1);

(b) inserting the respective first ends (8) of the at least one generally U-shaped inner tube (5, 5') into the reception section (2) of the preshaped flare (1), the reception opening being generally oval in shape (2, 2'), said first ends (8) each surrounding a respective preheatable electrode (12, 12');

(c) heating the reception section (2) of the preshaped flare (1) to a temperature suited for the deformation of the glass, with the first ends (8) of the U-shaped inner tubes (5, 5') located therein and being heated simultaneously;

(d) carrying out a press-sealing process of the positioned, glass members softened by heating in step (c), the hermetic sealing of all of said at least one generally U-shaped inner tube (5, 5') being effected in one working step;

(e) placing the outer envelope (10) over the assembly so obtained in step (d) with a lower portion of said outer envelope (10) adjacent the outwardly facing rim (3) of the preshaped flare (1); and (f) heating and continuously rotating said assembly obtained in step (d), the heating being carried out in the region of the lower, outwardly facing rim (3) of the preshaped flare (1) to a temperature suited for the deformation of the glass, whereby the heated lower end portion of the outer envelope (10) is hermetically sealed to the heated rim (3) of the flare (1).

16. The method of claim 14, wherein said outer envelope is placed such that a lower free end portion thereof projects beyond said rim (3); and wherein during said heating and rotating step, the lower portion of said outer envelope (10) which projects beyond said rim (3) falls off due to said heating and due to its own weight.

17. The method of claim 14, wherein the heated portion of said outer envelope (10) is pressed against the heated rim (3) of the flare (1) with a roller so as to be hermetically sealed thereto.

* * * * *